US005835065A

United States Patent [19]

Wallace et al.

[11] Patent Number: 5,835,065

[45] Date of Patent: Nov. 10, 1998

[54] VARIABLE LENGTH WHIP WITH HELIX ANTENNA SYSTEM

[75] Inventors: Raymond C. Wallace, San Diego; John K. M. Lee, Ramona; Roger W. Martin, San Diego, all of Calif.

[73] Assignee: Qualcomm Incorporated, San Diego, Calif.

[21] Appl. No.: 719,297

[22] Filed: Sep. 19, 1996

[51] Int. Cl.[6] ..... H01Q 1/24

[52] U.S. Cl. ..... 343/702; 343/895; 343/900

[58] Field of Search ..... 343/702, 895, 343/900, 901; 455/89, 90; H01Q 1/24

[56] References Cited

U.S. PATENT DOCUMENTS 5,594,457 1/1997 Wingo ..... 343/895

*Primary Examiner*—Hoanganh T. Le

*Attorney, Agent, or Firm*—Russell B. Miller; Roger W. Martin

[57] ABSTRACT

An antenna system for a communication device. A whip antenna is surrounded by a helical antenna. A switch couples the helical antenna to the signal source when the whip antenna is in a retracted position. The whip antenna is comprised of an upper conductive portion, a lower conductive portion, and a dielectric portion which isolates the upper and lower conductive portions from each other. A conductive sleeve member surrounds the whip antenna and is slidably mounted thereon. In a first embodiment, when the whip antenna is extended, the conductive sleeve member slides over the dielectric portion, coupling the upper and lower conductive portions together. As the whip antenna is retracted, the helical antenna pushes the conductive sleeve member to the top end of the whip antenna, isolating the whip antenna from the helical antenna. In a second embodiment, the helical antenna is an integral part of the conductive sleeve member.

26 Claims, 4 Drawing Sheets

VARIABLE LENGTH WHIP WITH HELIX ANTENNA SYSTEM

BACKGROUND OF THE INVENTION

I. Field of the Invention

The present invention relates generally to antennas. More particularly, the present invention is directed to a novel and improved variable length whip and helix antenna system for use in a portable communication device.

II. Description of the Related Art

Portable communication devices, such as portable radiotelephones, typically employ a simple dipole whip antenna as the main antenna. This antenna is usually retractable to make the unit more compact when a call is not in progress. However, when the whip antenna is retracted within the portable radiotelephone housing, the efficiency of the antenna is substantially reduced due to the presence of conductive objects in the antenna pattern.

Several prior art antenna systems attempt to compensate for these object-induced nulls in the whip antenna pattern. For example, some prior art portable radiotelephones utilize a compact helical antenna as an auxiliary antenna, with the main whip antenna extending through the center of the helix. In these prior art portable radiotelephones, the helical antenna remains exposed while the main antenna is retracted within the radiotelephone housing. As such, the helical antenna is able to receive and transmit radio frequency (RF) signals even though the main antenna is retracted.

However, since the main whip antenna extends through the center of the helical antenna, there may be RF coupling between the helical antenna and the whip antenna when the helical antenna is in use, i.e. when the whip antenna is retracted. This coupling results in an undesirable loss of efficiency of the helical antenna. Some prior art antenna systems attempt to avoid this undesirable loss of efficiency due to coupling by fabricating a whip antenna in which a substantial length of the top portion of the whip antenna is constructed of a non-conductive material, such as plastic.

Such a prior art antenna system 100 is illustrated in FIGS. 1A and 1B. In FIG. 1A, prior art antenna system 100 is seen to comprise a whip antenna 102 and a helical antenna 104. Whip antenna 102 comprises a conductive portion 108 and a non-conductive portion 110. Helical antenna 104 is typically encased in a dielectric housing 106 which is external to portable radiotelephone housing 150. In FIG. 1A, whip antenna 102 is fully extended, exposing conductive portion 108. In this position, helical antenna 104 surrounds the bottom of conductive portion 108.

In FIG. 1B, whip antenna 102 is fully retracted, and helical antenna 104 receives and transmits RF signals. In this position, helical antenna 104 surrounds the non-conductive portion 110 of whip antenna 102. Since the non-conductive portion 110 does not couple signal energy from helical antenna 104, the undesirable loss in efficiency by parasitic coupling of whip antenna 102 described above is avoided.

However, a problem with the prior art solution described above is that when whip antenna 102 is in the extended position as shown in FIG. 1A, helical antenna 104 has an unintended effect on the antenna pattern of whip antenna 102. Some of the energy intended to be radiated through whip antenna 102 is coupled to helical antenna 104. In many applications, this parasitic coupling by the helical antenna 104 is undesirable and inefficient in much the same way as the parasitic coupling by the whip antenna 102 as described above.

Another problem with the prior art solution as shown in FIGS. 1A and 1B is that the length of whip antenna 102 must be increased to incorporate non-conductive portion 110. This results in an overall antenna length that is greater than is necessary for whip antenna 102 to perform efficiently. When whip antenna 102 is extended, the non-conductive portion 110 serves no functional purpose, increasing the physical antenna length without increasing the antenna electrical length. This extra length adds size, cost and weight to the portable radiotelephone 150.

What is needed is a combination whip/helix antenna system which operates efficiently whether the whip antenna is extended or retracted, and in which the length of the whip antenna is independent of coupling considerations with the helical antenna.

SUMMARY OF THE INVENTION

The present invention is a novel and improved antenna system for a communication device. In the preferred embodiment, a whip antenna is surrounded by a helical antenna. The preferred embodiment of the antenna system further comprises a mechanical switch which couples the helical antenna to the signal source when the whip antenna is in a retracted position. The whip antenna is comprised of an upper conductive portion, a lower conductive portion, and an intermediate dielectric portion connected between the upper and lower conductive portions and isolating the upper and lower conductive portions from each other. A conductive sleeve member also surrounds the whip antenna and is slidably mounted thereon.

In a first embodiment, the helical antenna and the conductive sleeve member are two separate elements, with the helical antenna being fixedly mounted to the housing of the communication device. In this first embodiment, when the whip antenna is extended, the conductive sleeve member slides over the dielectric portion, coupling the upper and lower conductive portions together. As the whip antenna is retracted, the helical antenna pushes the conductive sleeve member to the top end of the whip antenna, isolating the whip antenna from the helical antenna. Furthermore, when the whip antenna is retracted, the mechanical switch couples the helical antenna to the signal source.

In a second embodiment, the helical antenna is an integral part of the conductive sleeve member. In this second embodiment, when the whip antenna is extended, the conductive sleeve member containing the helical antenna slides over the dielectric portion, coupling the upper and lower conductive portions together through the helical antenna element. The resulting antenna structure is a single radiating element having a lower whip-like conductive portion, an intermediate helical conductive portion, and an upper whip-like conductive portion. As the whip antenna is retracted, the housing of the communication device pushes the conductive sleeve member containing the helical antenna to the top end of the whip antenna, thereby isolating the whip antenna from the helical antenna. Furthermore, when the whip antenna is retracted, the mechanical switch couples the conductive sleeve member containing the helical antenna to the signal source.

In both of the above embodiments, since the conductive sleeve member couples the upper and lower conductive portions together when the whip antenna is extended, the physical length of the whip antenna is dictated only by the desired electrical length, and not by adverse RF coupling considerations. Furthermore, when the whip antenna is retracted, it does not adversely affect the antenna gain pattern of the helical antenna.

BRIEF DESCRIPTION OF THE DRAWINGS

The features, objects, and advantages of the present invention will become more apparent from the detailed description set forth below when taken in conjunction with the drawings in which like reference characters identify correspondingly throughout and wherein.

DETAILED DESCRIPTION OF THE PREFERRED EMBODIMENTS

Figure 2A:
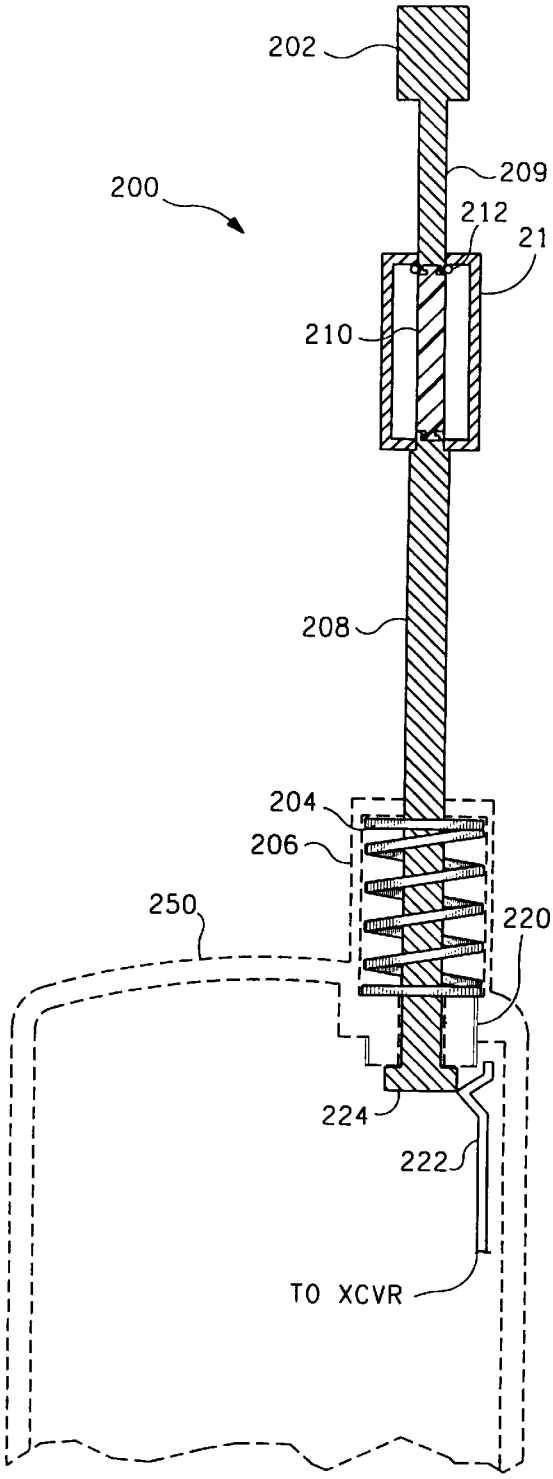
FIG. 2A is an illustration of a first embodiment of the antenna system of the present invention with the whip antenna extended and the sleeve member in cut-away view.
Figure 2B:
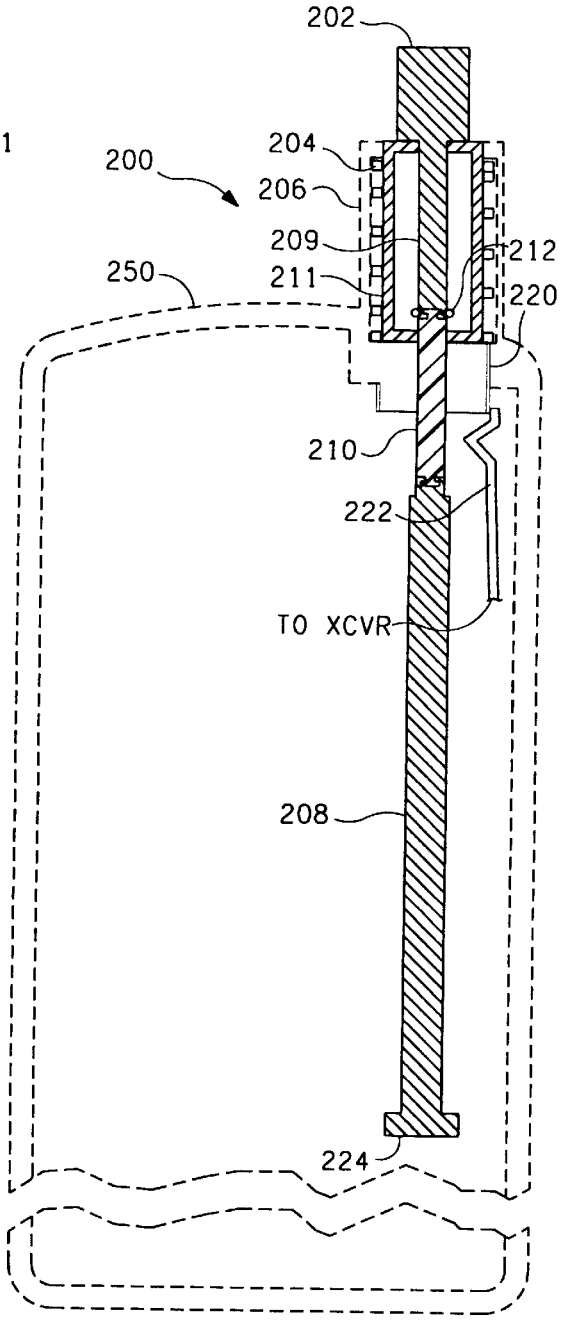
FIG. 2B is an illustration of the antenna system of FIG. 2A with the whip antenna retracted and the sleeve member in cut-away view.

A first embodiment of the antenna system 200 of the present invention as shown in FIGS. 2A and 2B comprises a whip antenna 202 inserted longitudinally through the center of helical antenna 204. Helical antenna 204 is preferably encased in a dielectric casing 206 such as plastic, and is mounted externally on portable radiotelephone housing 250 by means known in the art; for example, by a threaded insert (not shown). Whip antenna 202 may be extended as shown in FIG. 2A, or retracted within portable radiotelephone housing 250 as shown in FIG. 2B. In this first embodiment, regardless of whether whip antenna 202 is extended or retracted, helical antenna 204 remains mounted externally on housing 250.

When whip antenna 202 is extended as shown in FIG. 2A, the helical antenna 204 is preferably not used, although it may be used to intentionally augment or alter the antenna gain pattern of whip antenna 202. In order to switch out helical antenna 204 when whip antenna 202 is extended, a variety of electrical or mechanical switches may be used. For example, in FIGS. 2A and 2B, a feed point 220 of helical antenna 204 extends downwardly from the coils of helical antenna 204. As can be seen from FIG. 2B, when whip antenna 202 is in a retracted position, feed point 220 is contacted by a spring arm 222 which provides signals to and from the radiotelephone's transceiver (not shown). Spring arm 222 is held securely against feed point 220 by a lateral spring force. However, when whip antenna 202 is in an extended position as shown in FIG. 2A, a widened portion 224 at the bottom of whip antenna 202 engages spring arm 222, pushing spring arm laterally away from feed point 220 and electrically de-coupling spring arm 222 from helical antenna feed point 220. By switching out helical antenna 204 when whip antenna 202 is extended, one may avoid undesirable alterations or inefficiencies in the antenna gain pattern of whip antenna 202 when it is extended.

In another aspect of the first embodiment of the present invention, whip antenna 202 comprises an upper conductive portion 209, a lower conductive portion 208, and an intermediate dielectric portion 210. A sliding sleeve member 211 surrounds whip antenna 202 and is slidably mounted thereon. In this first embodiment, sleeve member 211 is made of a conductive material, such as copper, steel or the like, and optionally may be outwardly encased in a protective dielectric material such as plastic (not shown). Also, although helical antenna 204 is illustrated in FIG. 2A and 2B as a proper helix, it may also be of other construction as is known in the art; for example a solid cylinder, a braided mesh, or a loop antenna. Likewise, whip antenna 202 may be of various constructions, such as telescopic or fixed length. Both upper and lower conductive portions 209, 208 are constructed from metallic materials as are known in the art. Also, intermediate dielectric portion 210 is preferably constructed of a strong plastic, but may alternately be made of any non-conductive composite dielectric material as are known in the art.

When whip antenna 202 is extended from the portable radiotelephone housing 250 as shown in FIG. 2A, sleeve member 211 couples upper conductive portion 209 to lower conductive portion 208, thus bypassing intermediate dielectric portion 210 and providing electrical continuity throughout the length of whip antenna 202. In this extended position, whip antenna 202 conducts RF signals throughout its length. Current oscillates in whip antenna 202 through conductive portion 208, sleeve member 211, and upper conductive portion 209, enabling whip antenna 202 to transmit and receive RF signals using its entire physical length.

As was previously mentioned, when whip antenna 202 is extended as shown in FIG. 2A, helical antenna 204 may be switched out by the engagement of widened portion 224 with spring arm 222. In addition to switching out helical antenna 204, spring arm 222 may also be used to couple whip antenna 202 to the radiotelephone's transceiver (not shown) if widened portion 224 is made of a conductive material, or is an integral part of lower conductive portion 208. In such an embodiment, spring arm 222 would conduct RF signals to and from whip antenna 202 through widened portion 224 when whip antenna 202 is in the extended position shown in FIG. 2A, and would conduct RF signals to and from helical antenna 204 through feed point 220 otherwise, for example, when whip antenna 202 is in the retracted position shown in FIG. 2B.

In the first embodiment shown in FIGS. 2A and 2B, sleeve member 211 is a metallic cylinder having an inward turned "lip" or taper at each end for contacting the upper and lower conductive portions 209, 208. Alternatively, sleeve member 211 may be a "clip" arrangement which does not completely surround whip antenna 202. Optionally, an upper lip of sleeve member 211 also engages sleeve stop 212. Sleeve member 211 physically rests against sleeve stop 212 when whip antenna 202 is in the extended position illustrated in FIG. 2A. Sleeve stop 212 may be a "bump" on the upper conductive portion 209 as shown, or it may be a mere widening or flare of upper conductive portion 209. Alternatively, sleeve stop 212 may be an integral part of lower conductive portion 208 as is shown in FIGS. 2A and 2B. Clearly, there are may different ways to physically suspend sleeve member 211 such that it bridges intermediate dielectric portion 210, coupling upper conductive portion 209 to lower conductive portion 208.

When whip antenna 202 is retracted substantially within portable radiotelephone housing 250 as shown in FIG. 2B, sleeve member 211 is pushed to the top of whip antenna 202, de-coupling upper conductive portion 209 from lower conductive portion 208, and allowing intermediate dielectric portion to electrically isolate upper conductive portion 209 from lower conductive portion 208. In this retracted position, helical antenna 204 is isolated from lower conductive portion 208 by the physical distance of intermediate dielectric portion 210. As such, RF signals received and radiated by helical antenna 204 are not coupled to the entire length of whip antenna 202, although there may be some negligible coupling to sleeve member 211 and upper conductive portion 209.

In the first embodiment shown in FIG. 2B, sleeve member 211 has an outer diameter smaller than the inner diameter of helical antenna 204, and thus slides in between upper conductive portion 209 and helical antenna 204 when whip antenna 202 is in the retracted position. The sliding of sleeve member 211 as whip antenna 202 is moved from the extended position of FIG. 2A to the retracted position of FIG. 2B may be arrested by engaging a lower lip on sleeve stop 212. Alternatively it may be arrested by engaging an upper lip on a widened upper end of upper conductive portion 209. Based on the length of sleeve member 211 and the size and location of intermediate dielectric portion 210 along the length of whip antenna 202, one may design many different schemes as are known in the art for limiting the travel of sleeve member 211 along the length of whip antenna 202.

Figure 3A:
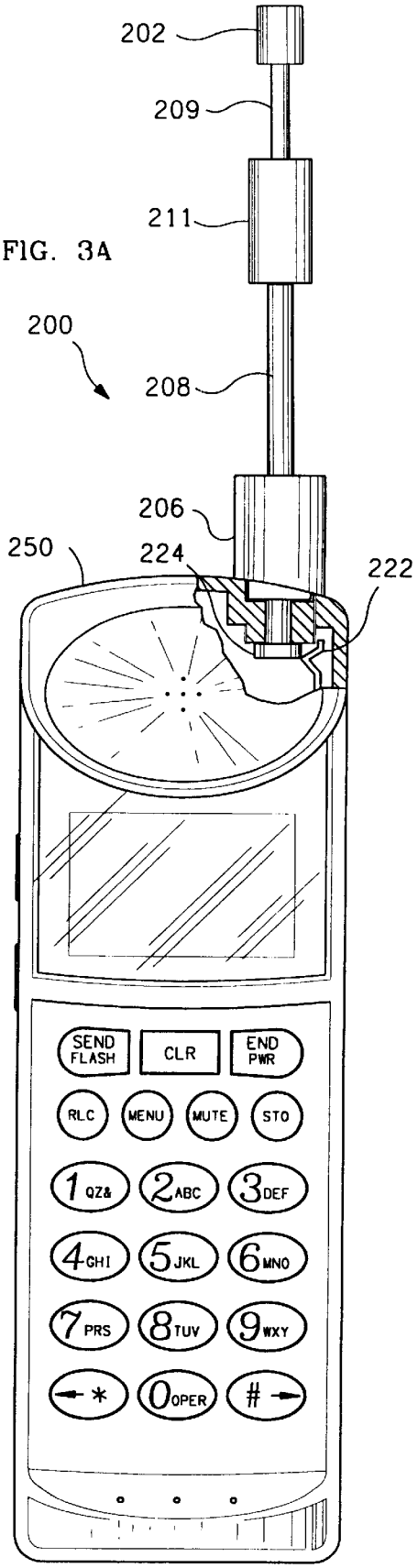
FIG. 3A is an illustration of an exemplary portable radiotelephone, shown in partially cut-away view, employing the first embodiment of the antenna system of the present invention with the whip antenna extended.
Figure 3B:
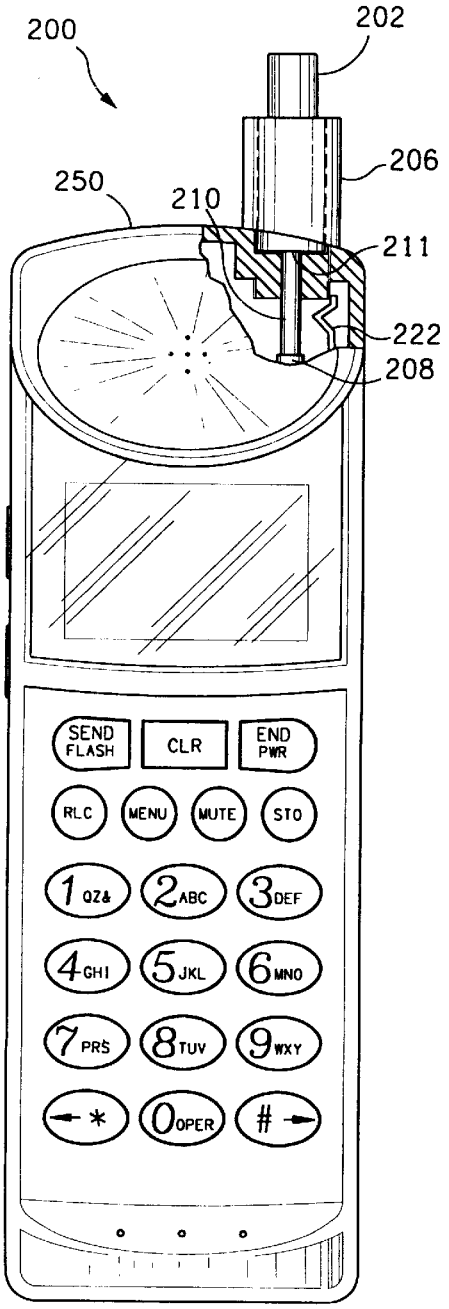
FIG. 3B is an illustration of an exemplary portable radiotelephone of FIG. 3A with the whip antenna retracted.

FIGS. 3A and 3B illustrate a partially cut-away view of the first embodiment of the antenna system 200 of the present invention employed by a portable radiotelephone 250 suitable for use with the present invention. When whip antenna 202 is in the extended position of FIG. 3A, spring arm 222 engages widened portion 224, switching out the helical antenna encased in dielectric housing 206. Also, sleeve member 211 (here shown as a metallic cylinder with a lip at a top end) couples upper conductive portion 209 to lower conductive portion 208, providing for full electrical continuity along the length of whip antenna 202. When whip antenna 202 is in the retracted position of FIG. 3B, spring arm 222 connects to the helical antenna encased in dielectric housing 206. Also, sleeve member 211 slides to the top of upper conductive portion 209, thus de-coupling upper conductive portion 209 from lower conductive portion 208. In this position, the upper conductive portion 209 of whip antenna 202, and the helical antenna encased in dielectric housing 206 are isolated from lower conductive portion 208 by intermediate dielectric portion 210.

Figure 1B:
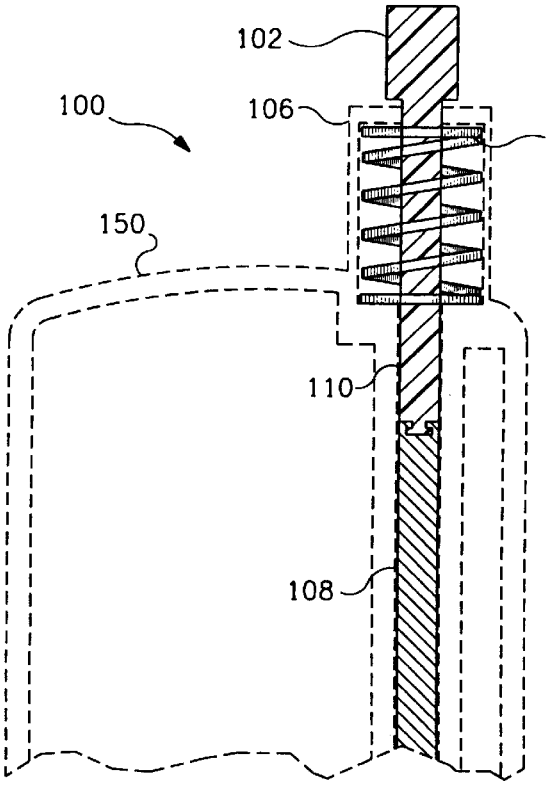
FIG. 1B PRIOR ART
FIG. 1B is an illustration of the antenna system of FIG. 1A in which the whip antenna is retracted.
Figure 1A:
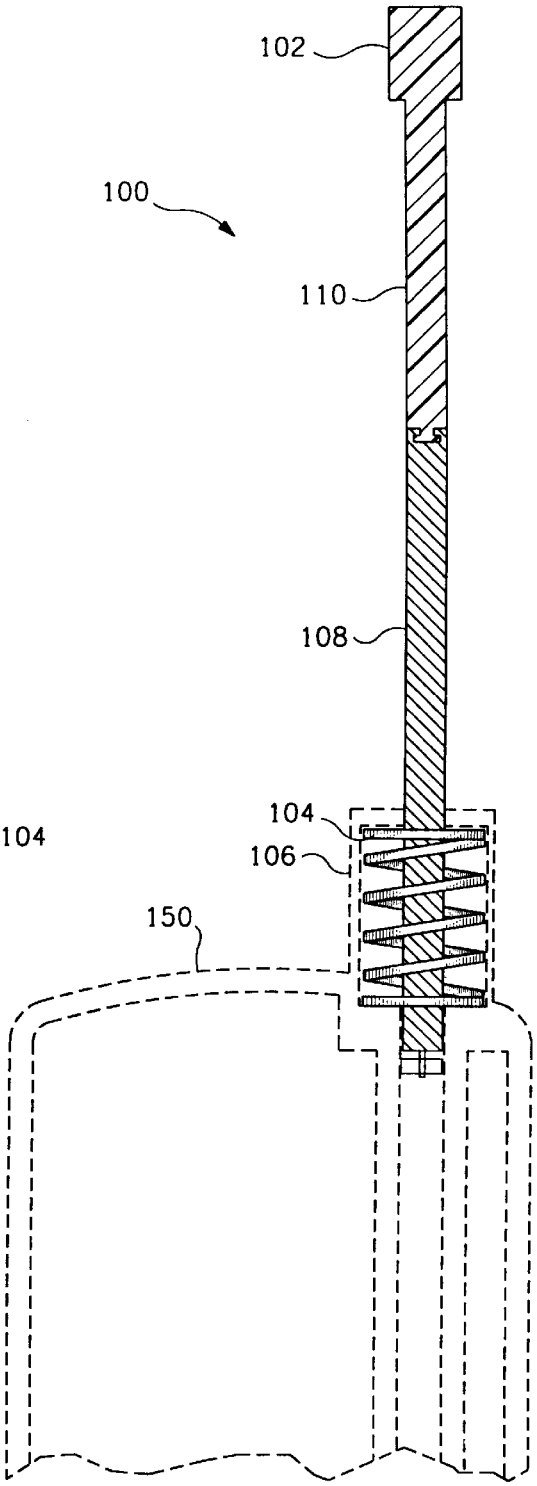
FIG. 1A PRIOR ART
FIG. 1A is an illustration of a prior art antenna system in which the whip antenna is extended.

In this first embodiment of the present invention, spring arm 222 provides for the reduction of parasitic coupling by helical antenna 204 (see FIGS. 2A and 2B) when whip antenna 202 is extended, while sleeve member 211 provides for the reduction of parasitic coupling by whip antenna 202 when whip antenna 202 is retracted. Furthermore, sleeve member 211 allows the full physical length of whip antenna 202 to be used for receiving and radiating RF signals, without adding the additional length required in the prior art antenna system shown in FIGS. 1A and 1B. Thus, the physical length of whip antenna 202 in the present invention is independent of adverse coupling considerations found in the prior art antenna systems. Additionally, sleeve member 211 adds negligible size and weight to the phone, and may be compactly stored within helical antenna 204 when whip antenna 202 is retracted.

Figure 4A:
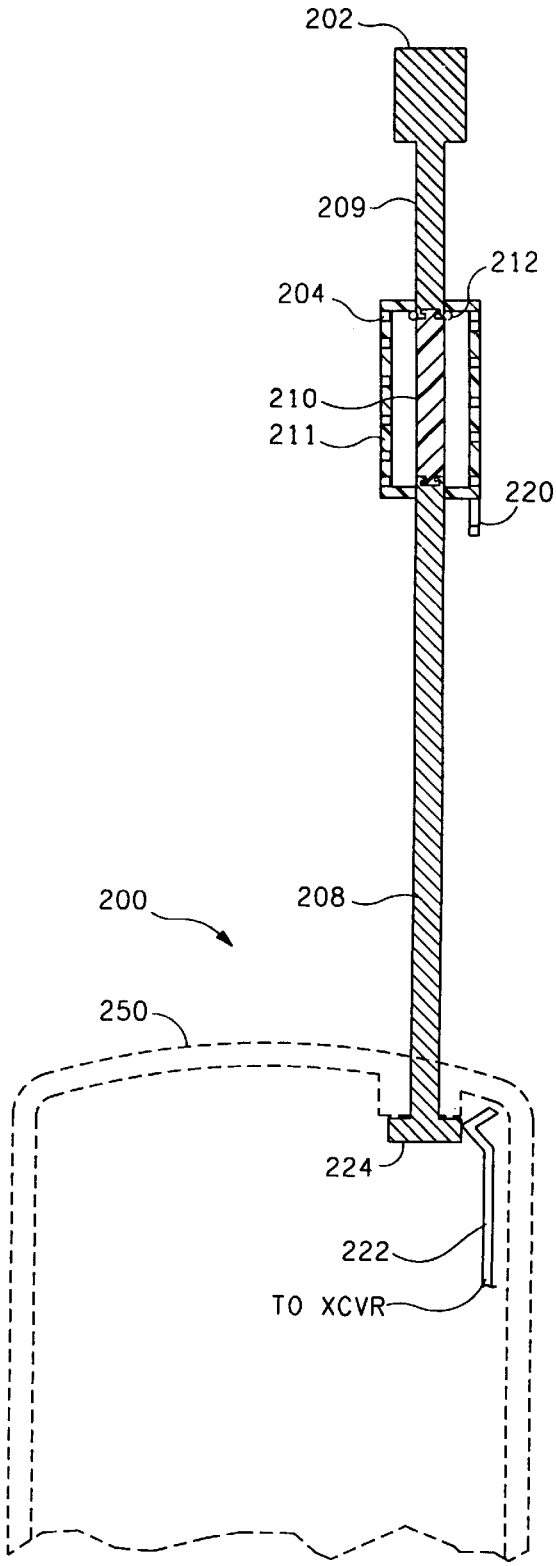
FIG. 4A is an illustration of a second embodiment of the antenna system of the present invention with the whip antenna extended and the sleeve member in cut-away view.
Figure 4B:
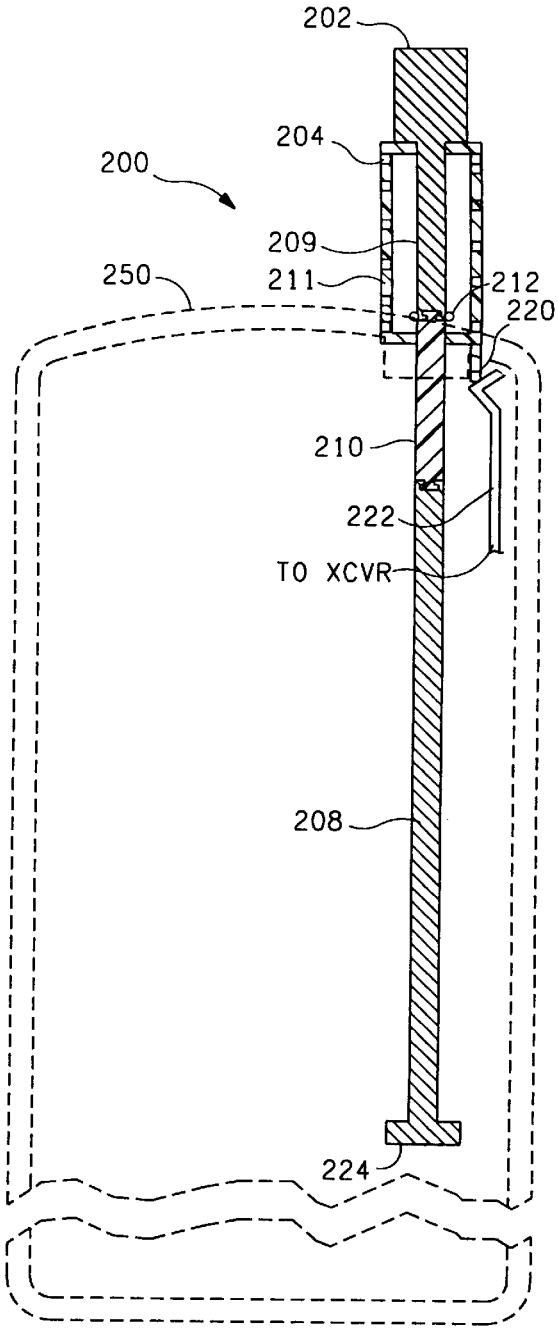
FIG. 4B is an illustration of the antenna system of FIG. 4A with the whip antenna retracted and the sleeve member in cut-away view.

A second embodiment of the antenna system 200 of the present invention is illustrated in FIGS. 4A and 4B. This second embodiment is similar to the first embodiment in that sleeve member 211 couples upper conductive portion 209 to lower conductive portion 208 when whip antenna 202 is in the extended position as shown in FIG. 4A. However, in contrast to the first embodiment, helical antenna 204 is not fixedly mounted to the housing of portable radiotelephone 250. In this second embodiment, helical antenna 204 is an integral part of sleeve member 211, and current actually flows through helical antenna 204 when whip antenna 202 is in the extended position. Preferably, in this second embodiment, with the exception of helical antenna 204, sliding sleeve member 211 is a non-conductive dielectric plastic material. Thus, when whip antenna 202 is extended, the resulting radiating element comprises a whip-like lower conductive portion 208, the intermediate helical conductive portion of helical antenna 204 encased in sleeve member 211, and the upper conductive portion 209. When whip antenna 202 is in this extended position, helical antenna 204 behaves like a phasing coil, extending the electrical length of whip antenna 202, while concentrating its radiating pattern along the horizontal plane. Alternatively, sleeve member 211 may still be a conductive material, however this would obviate the need for the helical antenna 204, and the sleeve member 211 would merely act as a cylindrical radiator.

When whip antenna 202 is retracted as shown in FIG. 4B, sleeve member 211 and integral helical antenna 204 are pushed to the top of whip antenna 202, but remain exposed externally to portable radiotelephone housing 250. However, feed point 220 of helical antenna 204 extends internally into portable radiotelephone housing 250 to make electrical contact with spring arm 222. Thus, when whip antenna 202 is retracted, this second embodiment behaves similarly to the first embodiment of FIGS. 2A and 2B with helical antenna 204 acting as the primary radiator, while still isolating lower conductive portion 208 from whip antenna 204 by intermediate dielectric portion 210. Alternatively, feed point 220 may be directly coupled to sleeve member 211 if sleeve member 211 is made from a conductive material. In such a case, the sleeve member 211 would act as a cylindrical radiator.

The previous description of the preferred embodiments is provided to enable any person skilled in the art to make or use the present invention. The various modifications to these embodiments will be readily apparent to those skilled in the art, and the generic principles defined herein may be applied to other embodiments without the use of the inventive faculty. Thus, the present invention is not intended to be limited to the embodiments shown herein but is to be accorded the widest scope consistent with the principles and novel features disclosed herein.

We claim:

1. An antenna system comprising:

a first antenna element having an extended position and a retracted position, said first antenna element comprising:

a first conductive portion;

a second conductive portion; and a dielectric portion, disposed between said first and second conductive portions, for electrically isolating said first and second conductive portions when said first antenna element is in said retracted position;

a second antenna element proximate said first antenna element; and a conductive sleeve member, for conductively coupling said first conductive portion to said second conductive portion when said first antenna element is in said extended position.

2. The antenna system of claim 1 wherein said first antenna element is a whip antenna and said second antenna element is a helical antenna, said whip antenna extending longitudinally through a center of said helical antenna.

3. The antenna system of claim 2 wherein said conductive sleeve member is a conductive cylinder slidably mounted on, and substantially surrounding, said whip antenna.

4. The antenna system of claim 3 wherein said whip antenna further comprises means for preventing said conductive sleeve member from sliding beyond a predetermined location along said whip antenna.

5. The antenna system of claim 4 wherein said means for preventing comprises a stop mounted to said first conductive portion of said whip antenna.

6. The antenna system of claim 5 wherein an outer diameter of said conductive sleeve member is less than an inner diameter of said helical antenna, and wherein said conductive sleeve member is accommodated substantially within said center of said helical antenna when said whip antenna is in said retracted position.

7. The antenna system of claim 2 wherein said conductive sleeve member is a metallic clip slidably mounted on said whip antenna.

8. The antenna system of claim 7 wherein said whip antenna further comprises means for preventing said conductive sleeve member from sliding beyond a predetermined location along said whip antenna.

9. The antenna system of claim 8 wherein said means for preventing comprises a stop mounted to said first conductive portion of said whip antenna.

10. The antenna system of claim 9 wherein said conductive sleeve member is accommodated substantially within said center of said helical antenna when said whip antenna is in said retracted position.

11. An antenna system for use in a communication device having a housing, said antenna system comprising:

a first antenna element having an extended position wherein said first antenna element is substantially disposed externally to said housing and a retracted position wherein said first antenna element is substantially disposed internally to said housing, said first antenna element having a widened portion at a lower end said first antenna element further comprising:

a first conductive portion;

a second conductive portion; and a dielectric portion, disposed between said first and second conductive portions, for electrically isolating said first and second conductive portions when said first antenna element is in said retracted position;

a second antenna element, disposed externally to said housing and surrounding said first antenna element;

a conductive sleeve member, for coupling said first conductive portion to said second conductive portion when said first antenna element is in said extended position; and a spring arm for alternately coupling signals to and from said first and second antenna elements, said spring arm being disposed within said housing such that said widened portion of said first antenna element decouples said spring arm from said second antenna element when said first antenna element is in said extended position.

12. The antenna system of claim 11 wherein said first antenna element is a whip antenna and said second antenna element is a helical antenna, said whip antenna extending longitudinally through a center of said helical antenna.

13. The antenna system of claim 12 wherein said widened portion of said first antenna element is electrically conductive and wherein said spring arm couples signals to and from said first antenna element when said first antenna element is in said extended position.

14. The antenna system of claim 11 wherein said first antenna element is a whip antenna and said second antenna element is a helical antenna, said whip antenna extending longitudinally through a center of said helical antenna.

15. The antenna system of claim 14 wherein said conductive sleeve member is a conductive cylinder slidably mounted on, and substantially surrounding, said whip antenna.

16. The antenna system of claim 15 wherein said whip antenna further comprises means for preventing said conductive sleeve member from sliding beyond a predetermined location along said whip antenna.

17. The antenna system of claim 16 wherein said means for preventing comprises a stop mounted to said first conductive portion of said whip antenna.

18. The antenna system of claim 17 wherein an outer diameter of said conductive sleeve member is less than an inner diameter of said helical antenna, and wherein said conductive sleeve member is accommodated substantially within said center of said helical antenna when said whip antenna is in said retracted position.

19. The antenna system of claim 18 wherein said conductive sleeve member is a metallic clip slidably mounted on said whip antenna.

20. The antenna system of claim 19 wherein said whip antenna further comprises means for preventing said conductive sleeve member from sliding beyond a predetermined location along said whip antenna.

21. The antenna system of claim 20 wherein said means for preventing comprises a stop mounted to said first conductive portion of said whip antenna.

22. The antenna system of claim 21 wherein said conductive sleeve member is accommodated substantially within said center of said helical antenna when said whip antenna is in said retracted position.

23. An antenna system for use in a communication device having a housing, said antenna system comprising:

a first antenna element having an extended position wherein said first antenna element is substantially disposed externally to said housing and a retracted position wherein said first antenna element is substantially disposed internally to said housing, said first antenna element having a widened portion at a lower end, said first antenna element further comprising:

a first conductive portion;

a second conductive portion; and a dielectric portion, disposed between said first and second conductive portions, for electrically isolating said first and second conductive portions when said first antenna element is in said retracted position; and a spring arm for alternately coupling signals to and from said first and second antenna elements, said spring arm being disposed within said housing such that said widened portion of said first antenna element decouples said spring arm from said second antenna element when said first antenna element is in said extended position wherein said second antenna element couples said first conductive portion to said second conductive portion when said first antenna element is in said extended position.

24. The antenna system of claim 23 wherein said first antenna element is a whip antenna and said second antenna element is a helical antenna, said whip antenna extending longitudinally through a center of said helical antenna.

25. The antenna system of claim 24 wherein said whip antenna further comprises means for preventing said second antenna element from sliding beyond a predetermined location along said whip antenna.

26. The antenna system of claim 25 wherein said means for preventing comprises a stop mounted to said first conductive portion of said whip antenna.

* * * * *